US006637624B1

(12) United States Patent
Lassota

(10) Patent No.: US 6,637,624 B1
(45) Date of Patent: Oct. 28, 2003

(54) BEVERAGE DISPENSING URN WITH SURFACE-COVERING MEMBER AND METHOD

(75) Inventor: Zbigniew G. Lassota, Long Grove, IL (US)

(73) Assignee: Food Equipment Technologies Company, Inc., Lincolnshire, IL (US)

( * ) Notice: Subject to any disclaimer, the term of this patent is extended or adjusted under 35 U.S.C. 154(b) by 42 days.

(21) Appl. No.: 09/931,602

(22) Filed: Aug. 16, 2001

Related U.S. Application Data

(60) Provisional application No. 60/278,850, filed on Mar. 26, 2001.

(51) Int. Cl.[7] ..... B67D 5/64

(52) U.S. Cl. ..... 222/131; 222/183; 222/185.1; 222/386; 220/216; 220/592.18

(58) Field of Search ..... 222/386, 183, 222/184, 185.1, 130, 131; 220/216, 219, 592.01, 592.16, 592.2, 592.22, 592.27, 592.25, 592.28, 578, 592.18

(56) References Cited

U.S. PATENT DOCUMENTS 355,013 A * 12/1886 Halstead ..... 222/183
488,473 A * 12/1892 Fruen ..... 222/131
3,419,174 A * 12/1968 Engdahl ..... 220/560.12
3,987,941 A * 10/1976 Blessing ..... 222/386
4,471,892 A * 9/1984 Coleman ..... 222/386.5
4,733,792 A * 3/1988 Wasserman et al. ..... 220/216
4,938,377 A * 7/1990 Jarvis ..... 220/216

* cited by examiner

*Primary Examiner*—Gene Mancene
*Assistant Examiner*—Patrick Buechner
(74) *Attorney, Agent, or Firm*—James W. Potthast; Potthast & Associates

(57) ABSTRACT

A beverage dispensing urn (10) with a body (12) having a double-walled vacuum insulation construction with a movable insulation assembly (28) having a hollow movable insulating member (30, 30') made of an annular or cylindrical envelope of stainless steel that floats upon the surface (36) of the beverage (18) within the interior of the body (12) to insulate it from the portions of the body above the surface (36) and the air contained within the body and is slideably guided by the interior surface (34) of the body (12) and, in the case of the annular envelope, by a hollow guide member (42) that conveys beverage (18) from the inlet (16) to a portion (48) of the body (12) beneath the movable insulation member through an opening (44) in the movable insulating member.

28 Claims, 3 Drawing Sheets

BEVERAGE DISPENSING URN WITH SURFACE-COVERING MEMBER AND METHOD

CROSS-REFERENCE TO RELATED APPLICATION

This application claims, under 35 U.S.C. 119 (e), the benefit of U.S. Provisional application No. 60/278,850 filed Mar. 26, 2001 and entitled "Beverage Dispensing Urn with Surface Covering Member and Method", and assigned to the assignee of the present application.

BACKGROUND OF THE INVENTION

1. Field of the Invention

This invention relates generally to a dispensing beverage urn and more particularly to a dispensing beverage urn of the type having a dispensing faucet adjacent a bottom and a top for direct receipt of freshly brewed beverage.

2. Discussion of the Prior Art

Dispensing beverage urns, or dispensing urns, of the type having an inlet opening at the top into which beverage can be poured and a faucet at the bottom for dispensing the beverage into other smaller dispensers, such as insulated, pouring carafes, or directly into drinking cups are well known. Such dispensing urns generally have a cylindrical body with a double-walled construction. Often solid thermal insulating material is contained between the walls to reduce heat transfer though the walls.

The inlet opening is part of a funnel-like inlet, or other inlet, that is adapted to be in correct position adjacent to and beneath a drain-hole of a brew basket during the brewing process to receive freshly brewed beverage, such as freshly brewed coffee. After the dispenser removed from the brewer location to a dispensing location the inlet is closed to reduce heat loss.

The inventor has determined that there are one or more disadvantages or problems associated with the known dispensing urn described above. If the urn is immersed during cleaning, the solid insulation contained between the walls of the sides of the dispensing urn can become wet and thereby loose its heat insulating properties. On the other hand, if there is no insulation placed between the walls, the insulating capabilities of the urn are reduced. Insulating properties can be improved by providing a narrower a neck at the top and carry the body insulation along a shoulder that meets the neck to reduce heat loss through the top, but this reduces the top opening size and hinders visual access and manual access to the interior of the dispensing urn for purposes of cleaning.

In addition, in all known dispensing urns for coffee, the quality of the coffee in terms of taste, aroma, etc, deteriorates over time. The inventors believe that this is due in part to contact of the surface of the coffee within the urn with the hot air within the urn and located above the surface. More specifically, the inventors believed that the rate of deterioration is directly related to the ratio of the surface area of the coffee in contact with air to the volume of coffee contained within the urn. There is nothing in known beverage dispensing urns to reduce the rate of deterioration of coffee due to contact with the oxygen in the air.

SUMMARY OF THE INVENTION

It is therefore the object of the present invention to provide a beverage dispensing urn and method that overcomes the problems and disadvantages of the known beverage dispensing urns noted above.

This is achieved in part by providing a beverage dispensing urn having a hollow body, a top with an inlet for receipt of beverage, a bottom, a base for supporting the bottom above a support surface, and a dispensing faucet adjacent the bottom for dispensing beverage from the bottom, with a movable surface-covering assembly having a movable surface-covering member with a perimeter slightly smaller than that of an interior surface and which conforms to a cross sectional shape of the interior surface, and means for mounting the movable surface covering member within the body and on top of a top surface of the beverage in the container to insulate the top surface from portions of the body above the top surface of the beverage.

Preferably, the surface-covering member has an average density less than that of the beverage and floats on top of the top surface of the beverage, and is made of a stainless metal envelope surrounding a hollow core empty except for air, or evacuated, or filled with solid insulating material for enhancing insulation properties.

In one embodiment, the mounting means includes a vertical guide member located within the body, and the movable surface-covering member includes an opening for snug sliding receipt of the vertical guide member. Preferably, the guide member is hollow to convey beverage received at the inlet through and past the movable surface-covering member to a portion of the body beneath the movable surface-covering member, and is mounted to the top and extends downwardly from the top to a distal end adjacent the bottom.

Alternatively, the beverage passes through an opening in the relatively rigid movable insulating member without hollow guide member and the relative dimensions that enables close engagement of sides of the relatively rigid movable insulating member with the interior surface provides the only guide as the movable insulating member floats on top of the beverage. Alternatively, there is no opening in the surface-covering member and no down tube and all beverage passes through the gap between the interior surface of the body and the surface-covering member.

Because of the added insulation added by means of the movable surface-covering member good insulation properties are obtainable even when the body of the dispensing urn uses only an evacuated double wall construction for insulation without any solid insulation being interposed between the walls and a neck-less construction in which the top opening that is exposed when the top cover is removed is substantially coextensive with the bottom for easy access to the interior of the hollow body for cleaning and for installation and removal of the surface-covering assembly.

Thus, the object is also achieved by providing in a beverage dispensing urn having a hollow body, a top with an inlet for receipt of beverage, a bottom, a base for supporting the bottom above a support surface, and a dispensing faucet adjacent the bottom for dispensing beverage from the bottom, a method of reducing heat transfer of the beverage by performing the steps of insulating the body, and insulating a top surface of the beverage with a movably mounted insulating member.

Preferably, the step of insulating a top surface of the beverage with a movably mounted insulating member includes the step of floating the movably mounted insulating member on top of the beverage within the body, and the step of passing beverage received at the inlet into a portion of the body beneath the movably mounted insulating member includes the step of passing the beverage though an opening in the movable insulating member. Preferably, the beverage is passed from the inlet through an elongate tube that slideably extends through the opening in the movably mounted insulating member. The step of insulating the top surface of the beverage includes the step of insulating the top surface with a stainless metal insulator having a double wall construction and a core that enables the metal insulator to float on the top of the surface.

The object of the invention is also achieved in part by providing in a beverage dispensing urn having a hollow body, a top with an inlet for receipt of beverage, a bottom, a base for supporting the bottom, and a dispensing faucet adjacent for dispensing beverage from the bottom, a method of protecting beverage within the hollow body against contact with air by performing the steps of covering a top surface of the beverage contained within the hollow body with an air impermeable surface-covering member in contact with the top surface and moving the air impermeable member during movement of the level of the top surface of the beverage to maintain the air impermeable, surface-covering member in contact with the surface during said movement of the level.

Preferably, the surface-covering member moves with the level of the top surface of the beverage by floating on the top surface and the surface covering member also insulates the top surface of the beverage from portions of the hollow body located above the surface-covering member. In order to optimized durability and easy cleaning the surface-covering member is preferably a stainless metal envelope surrounding an insulating core.

The additional insulation provided by the surface-covering member enables the use of a top of the hollow body that is substantially coextensive with the hollow body, and the method includes the steps of removing the top from the hollow body to expose an opening at the top of the hollow body that is substantially coextensive with the bottom, and installing and removing the surface-covering body through the open top.

Preferably, the step of passing beverage into the hollow body is performed by passing the beverage through a tube extending from the inlet and through the surface-covering member to an outlet end located beneath the surface-covering member. The tube extends through an opening in the surface-covering member, and the covering member slides along the tube while within the opening during movement of the surface-covering member. Alternatively, the beverage is passed through a gap between the insulating member and the side of the hollow body.

BRIEF DESCRIPTION OF THE DRAWINGS

The foregoing advantageous and novel features of the dispensing urn of the present invention will be explained in greater detail and other advantageous features may be made apparent from the detailed description below that is given with reference to the several view of the drawing, in which.

DETAILED DESCRIPTION

Figure 1:
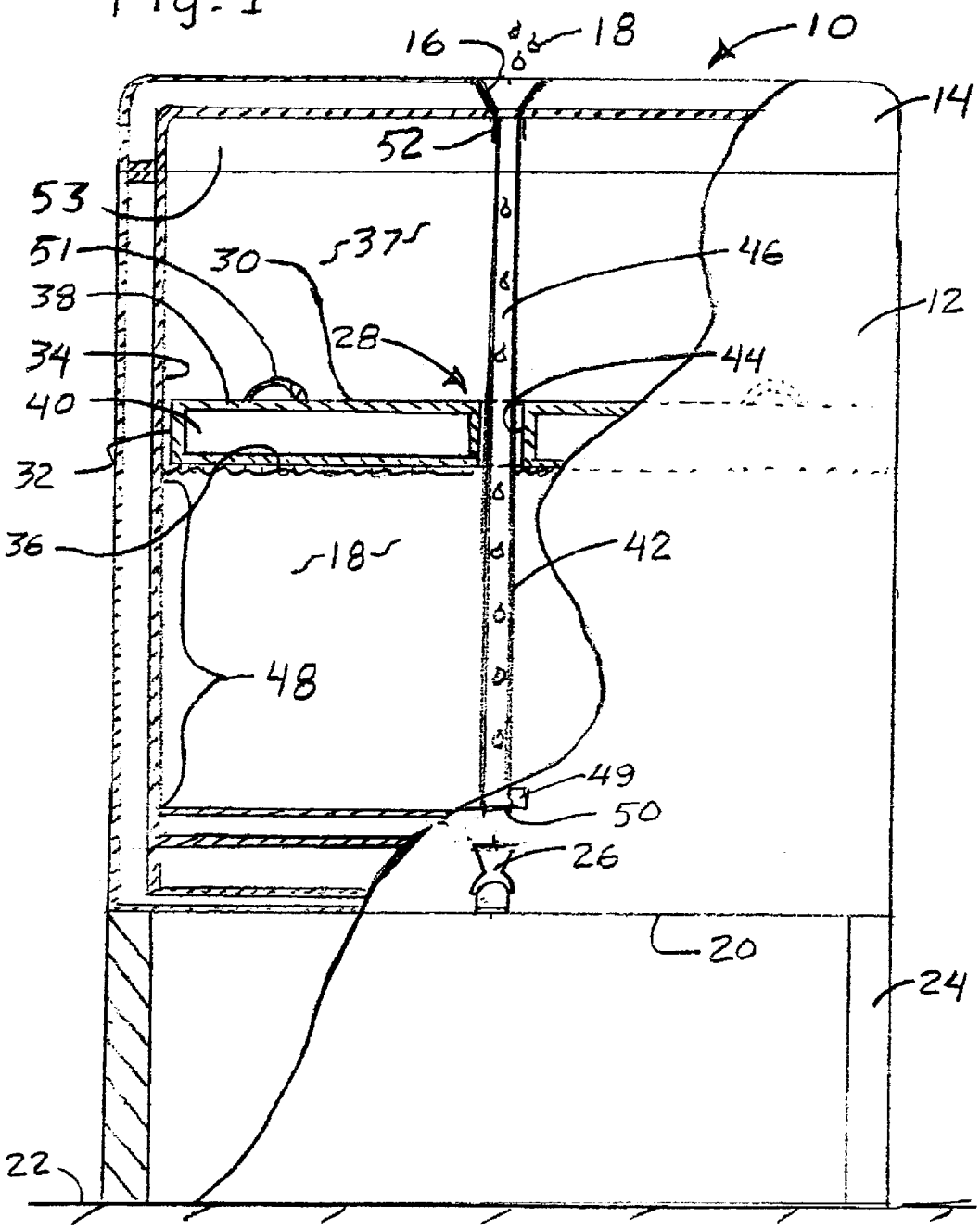
FIG. 1 is a schematic front view of a dispenser urn of the present invention with a cutaway portions in section to better illustrate some of the interior features.

Referring to FIG. 1 of the drawings, the preferred embodiment of the insulating urn 10 of the present invention is seen to include a cylindrical hollow body 12 with a circular top 14 carrying an inlet 16 for receipt of beverage 18, such as coffee draining from the bottom of a brew basket of a coffee maker, not shown. A bottom 20 is supported above an underlying support surface 22, such as a countertop, by a base 24. A dispensing faucet 26 adjacent the bottom 20 is provided for dispensing beverage 18 from the bottom part of the interior of the hollow body 12. These elements of a dispensing urn are well known and the details form no part of the present invention.

However, in accordance with the invention, the insulating urn 10 is provided with a movable, surface-covering insulator assembly 28. The movable insulator assembly 28 includes a movable surface-covering member 30 that is preferably relatively rigid, insulating, air impermeable and relatively noninteractive with the beverage 18. Preferably, the member is made from stainless steel. The movable, insulating, surface-covering member 30 has a perimeter 32 slightly smaller than the perimeter of interior surface 34 of the body 12. The movable insulating member 30 also is cylindrical and has a circular cross section to conform to the cross sectional shape of the interior surface 34 which is, in the case of a cylindrical body 12, circular. If the body 12 is different shape then the surface-covering member is given approximately the same different shape and approximately conforms in dimensions, but providing a gap between the perimeter 32 of the surface covering member 30 and the interior surface 34 on the order of approximately no more than 0.015–0.030 inch. The gap in the embodiment of FIG. 1 should be no more than needed to insure easy of relative sliding movement to maximize the percentage of surface being covered. The movable insulating member 30 is mounted within the body 12 and on top of a top surface 36 of the beverage 18 in the container. The surface covering member 30 thereby performs a dual function of insulating the top surface 36 from interior portions 37 of the body 12 located above the top surface 36 of the beverage 18 and also protecting the surface 36 from contact with the oxygen of the air within the hollow body 12 in the space 37 located above the surface-covering member 30.

Preferably, the movable, surface-covering member has an average density less than that of the beverage and thereby floats on top of the top surface of the beverage. This is preferably achieved by making the movable insulating member 30 of a stainless metal, such as stainless steel, envelope 38 surrounding and encasing a non-metal core 40. If the core 40 is hollow, and not filled with other insulating material, then preferably it is evacuated of air to improve insulation characteristics. The stainless steel is durable and easily cleaned and can withstand the heat within the dispensing urn 10.

The movable, insulating, surface-covering member 30 is constrained to move up and down with the level of the surface 18 and remains in close contact with the interior surface 34 by virtue of the relatively small distance separating the cylindrical side wall, or perimeter 32 of the surface-covering member 30 from the interior surface 34, preferably approximately no more than 0.015–0.030 inch.

In addition, in the dispenser 10 of FIG. 1 the movable insulating member 30 is mounted by means including a vertical guide member 42 located within the body 12 that extends through an opening 44 in the movable insulating member 30. The opening 44 and the guide member 42 are approximately the same size for snug sliding passage of vertical guide member 42 through the opening 44. Preferably, the clearance is no more than approximately 0.015–0.030 inch and is generally no greater than needed to insure smooth relatively sliding movement to maximize the surface area being covered by the surface-covering member.

The guide member, or down tube, 42 of dispenser assembly 10 serves a dual function. The guide member 42 is preferably a hollow down tube having an interior cylindrical passageway 46 to convey beverage 18 received at the inlet 16 through and past the movable insulating member 30 to a portion 48 of the body 12 beneath the movable insulating member 30. It comprises an elongate hollow tube extending from the inlet 16 and through the opening 44 in the relatively rigid, movable insulating member 30. The guide member 42, in such case, is mounted to the top 14 and extends downwardly from the top 14 to a distal end 49 adjacent the bottom 20. The distal end 49 may carry a removable annular collar 50 that has a diameter greater than that of the opening 44. The collar 50 will then carry the movable insulating member 30 off the bottom of the body 12 when the removable top 14 is removed and lifted off the top of the body 30. Preferably, the guide member 42 is located at the center of the top 14, and is either releasably connected to, or internally formed with, the inlet 16.

The vertical guide member 42 has a fixed end 52 mounted to the top 14, and an elongate cylindrical body that extends downwardly from the top 14 and the fixed inlet, or fixed end, 52 into the body 12 to the distal free end 49 located within the body 12. The distal free end 49 is located adjacent the bottom 20 of the body 12. If no collar 50 is provided, then preferably, the distance between the end 49 of the vertical guide member 42 and the interior of the bottom is less than the thickness of the movable insulating member 30 so that even when the movable insulating member is resting on the bottom 20 the end portion of the vertical guide member 42 is still received within the opening 44. In the absence of the collar 50, or in addition, a pair of handles 51 may be provided at the top of the surface-covering member 30 to facilitate removal after the vertical guide member 42 is removed from the opening 44.

The vertical guide member thereby passes beverage 18 from the inlet 16 to the location 48 beneath the movable insulating member 30. In the case of a hot beverage, such as hot coffee, filling the body 12 from the bottom reduces heat loss, for the heat tends to rise toward the top, and also because the coffee never comes into contact with the air contained within the body but outside of the down tube 42. It should be appreciated that when the dispensing urn 10 is first filled, the level 36 is at its maximum and the top of the movable insulating member 30 is adjacent to, or even pressed against the bottom surface of the top 14. Preferably, the top 14 has a concavity 53 within which the movable insulating member 30 is received while the surface of the beverage restrained to a level beneath the top of the body portion 12 of the insulating urn 10.

Advantageously, the selected relative dimensions enables close engagement of sides of the relatively rigid movable insulating member 30 with the interior surface 34 while the movable insulating member 30 is allowed to float on top of the beverage surface 36, even in the absence of the guide member 42. Thus, in the alternative embodiment of the invention shown in FIG. 2, the dispenser assembly 10' is substantially the same as the dispenser assembly of FIG. 1, except that the elongate guide member, or down tube 42, has been eliminated. If the same surface covering member 30 were used, the beverage 18 would simply spill onto the top of the movable insulating member, falling through air from the inlet 52 and then drains through the center opening 44. Alternatively, one or more smaller openings could be provided to reduce the heat loss through the center opening 44 or through any other openings that may be used instead of the center opening when no guide member is being used. This alternative construction will of course reduce the effectiveness of the surface-covering member 30 but the cost of another part and assembly of the part is eliminated which may justify the alternative construction.

Figure 2:
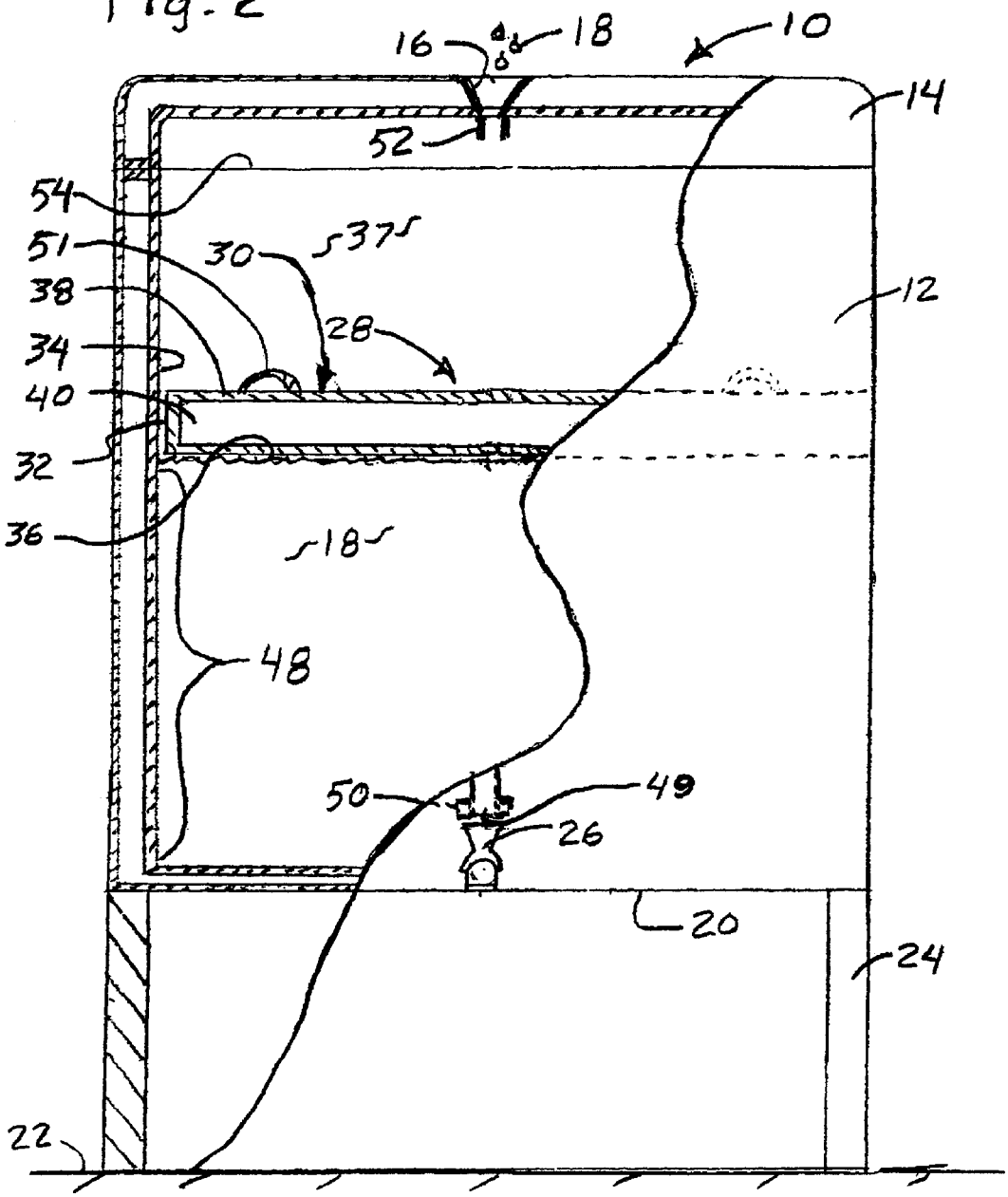
FIG. 2 is a schematic front view of another embodiment of the dispenser urn of the present invention similar to that of FIG. 1 but in which the center hole in the mobile surface-covering member has been removed.
Figure 3:
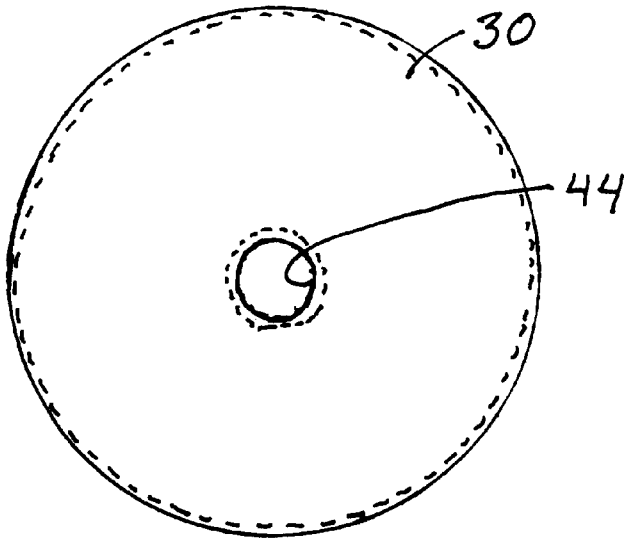
FIG. 3 is a top view of the mobile surface-covering member of the embodiment of FIG. 1.
Figure 4:
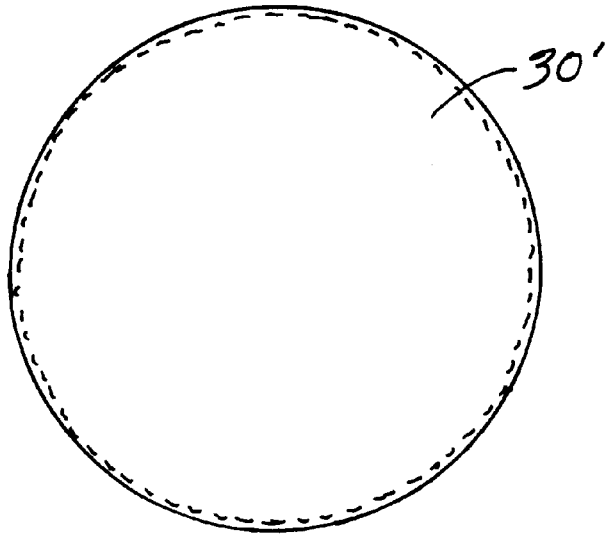
FIG. 4 is a top view of the mobile surface-covering member of the embodiment of FIG. 2.

Preferably, the center hole and all other holes are eliminated and the surface-covering member 30 of FIGS. 1 and 3 is replaced by a surface covering member 30' appears as shown in FIGS. 2 and 4. Preferably, the gap between the outside surface of the surface-covering member and the interior surface 34 of the body 12 is approximately the same as the gap dimension noted above with reference to the dispenser 10 of FIG. 1. However, the gap must not only be sufficient to enable smooth sliding movement of the surface covering member 30' within the body 12 but also sufficient to enable draining through the gap of the beverage 18 that lands on top of the covering member 30' to the portion 48 located beneath the covering member 30. The gap should be no larger than necessary to meet these dual functions of smooth sliding movement and draining. Although not necessary, the top of the covering member 30 may be slightly convex to more readily pass beverage to the perimeter gap for draining.

Because of the improved insulation by virtue of the movable insulation member 30 insulating the previously non-insulated surface 36 of the beverage 18 from the open atmosphere within the interior portion 37 of the body 12 of the urn assemblies 10 and 10', the temperature of the beverage is better maintained. Because of the separation of the top of the surface 36 of the beverage from the oxygen in the air it is believed that the taste and aroma qualities of the beverage, such as hot coffee, is better maintained.

Preferably, the body 12 is also insulating, preferably having an evacuated double construction but may also be provided with an insulation material filler between the walls. The movable insulation member 30 also preferably has an evacuated double wall, annular, or disc construction with an upper wall 56 and bottom wall 58 with an intermediate space 40 that is evacuated to provide vacuum insulation. While vacuum insulation may not be the best insulating technique, because of the improved insulation provided by the surface covering member 30, it is believed that such vacuum insulation of the body can be used and still obtain a good overall insulating result that may be better than achieved with solid insulation but a beverage surface open to the air above the surface 36. In addition a disadvantage of using insulating material located between the walls of the body 12 is that if the insulation becomes wet it insulation properties can be lost or deteriorate beneath that provided by vacuum, and this disadvantage is avoided. Many insulation materials that are used for this purpose may deteriorate over time.

Another advantage of the dispensers 10 and 10' is that because of the insulation provided by the surface-covering member, it is not necessary to provide a narrowed top with insulating shoulders and a narrow opening for enhanced insulation. Instead, this conventional structure required in the past may be replaced with the coextensive removable top, or top cover, 14 that spans entirely across the side walls of the hollow body 12, to coextensively cover both an open top 54 and the bottom 20, as shown in both FIGS. 1 and 2. This greatly facilitates access for visual inspection and manual cleaning of the interior of the hollow body 12, to the bottom 20 and to the interior of the drain tube connecting a drain hole (not shown) in the bottom of the hollow body 12 to the inlet of the faucet assembly 26.

While the surface-covering member need not be an insulator, preferably it does have good insulating properties. Thus, it is seen that one aspect of the invention is the provision of a method of reducing heat transfer of a beverage within a dispensing urn 10. This method is practiced by performing the steps of insulating the body 12 and insulating a top surface 36 of the beverage 18 with a movably mounted insulating member 30. The step of insulating a top surface 36 of the beverage 18 with a movably mounted insulating member 30 includes the step of floating the movably mounted insulating member 30 on top of the beverage 18 within the body 12. Beverage 18 received at the inlet 16 is passed into the lower portion 48 of the body 12 beneath the movably mounted insulating member 30 through the opening 44 in the movably mounted insulating member 30. In accordance with one aspect of the invention, the beverage 18 is passed from the inlet 16 through the elongate tube of the guide member 42 that slideably extends through the opening 44 in the movably mounted insulating member 30. In accordance with another aspect of the invention the beverage is allowed to pass through a gap between the surface covering-member 30 and the interior surface 34 of the body 12. Providing insulating properties to the surface-covering member 30 is achieved in part by providing a vacuum in the space 40 within the double-walled construction of the surface covering-member. Also, the top surface 36 is insulated with a metal insulator 30 having a double wall construction and a core 40 that enables the metal insulator 30 to float on the top 36 of the surface of beverage 18.

The advantage of covering the surface 36 of the beverage 18 to reduce contact with atmospheric oxygen in the upper portion 37 is obtained regardless of the insulation properties of the surface-covering member. Thus, another aspect of the invention is the provision in a beverage dispensing urn 10 or 10' having a hollow body 12, a top 14 with an inlet 16 for receipt of beverage, a bottom 20, a base for supporting the bottom 20, and a dispensing faucet 26 adjacent to the bottom 20 for dispensing beverage from the bottom 20 of a method of protecting beverage 18 within the hollow body 12 against contact with air by performing the steps of covering a top surface 36 of the beverage 18 contained within the hollow body 12 with an air impermeable surface-covering member 30 or 30' in contact with the top surface 18, and moving the air impermeable surface-covering member 30 or 30' during movement of the level of the top surface 36 of the beverage to maintain the air impermeable, surface-covering member in contact with the surface 36 during said movement of the level.

With the top cover 14 of the hollow body 12 being substantially coextensive with the hollow body, the method of the invention also includes the steps of removing the top 14 from the hollow body 12 to expose an opening 54 at the top of the hollow body 12 that is substantially coextensive with the bottom 20, and installing and removing the surface-covering member 30 through the open top 54.

While particular embodiments of the invention has been described in detail, it should be appreciated that many variations may be made thereto without departing from the spirit and scope of the invention as defined in the appended claims. For instance, although the surface covering member 30 has been shown as covering virtually all of the surface 36 except for side clearances or gaps needed at the perimeter 32 and the opening 44, the surface could also be covered with a plurality of smaller surface covering members which may combine to cover most of the surface 36, such as four 45-degree pie shaped surface-covering members, each of which could be passed through a smaller top opening that is not coextensive with the cross-section of the body 12. While preferably all of the materials that come in contact with the beverage are approved materials for contact with food such as stainless steel, food grade plastics and glass, other materials could be employed if desired. Other changes and variations will be apparent to those skilled in the art of dispensing urn design.

What is claimed is:

1. In a beverage dispensing urn having a hollow body, a top with an inlet for receipt of beverage, a bottom, a base for supporting the bottom above a support surface, and a dispensing faucet adjacent the bottom for dispensing beverage from the bottom, the improvement being a surface covering assembly, comprising:

a relatively rigid, substantially air impermeable, movable surface-covering member with a perimeter slightly smaller than that of an interior surface of the hollow body and which generally conforms to a cross sectional shape of the interior surface; and means for mounting the movable surface-covering member within the body and on top of a top surface of the beverage within the hollow body to reduce contact of air within the body with the surface of the beverage, the mounting means including a vertical guide member located within the body, and the surface-covering member including an opening for snug sliding receipt of the vertical guide member.

2. The beverage dispensing urn of claim 1 in which the distal free end is located adjacent the bottom of the body.

3. The beverage dispensing urn of claim 1 in which the vertical guide member has a fixed end mounted to the top, and a body that extends downwardly from the top and into the body to a distal free end located within the body.

4. The beverage dispensing urn of claim 3 in which the distal free end is located adjacent the bottom of the body.

5. The beverage dispensing urn of claim 1 in which the guide member is hollow to convey beverage received at the inlet through and past the movable insulating member to a portion of the body beneath the movable insulating member.

6. The beverage dispensing urn of claim 5 in which the guide member is mounted to the top and extends downwardly from the top to a distal end adjacent the bottom.

7. The beverage dispensing urn of claim 5 in which the top has a center and the guide member is located at the center.

8. The beverage dispensing urn of claim 5 in which the hollow guide member is connected to the inlet.

9. The beverage dispensing urn of claim 1 in which the surface-covering member is an insulating member with an average density less than that of the beverage to float on top of the top surface of the beverage.

10. The beverage dispensing urn of claim 9 in which the insulating member is made of a stainless metal envelope surrounding a non-metal core.

11. The beverage dispensing urn of claim 10 in which the core is hollow.

12. The beverage dispensing urn of claim 11 in which the core is evacuated of air.

13. In a beverage dispensing urn having a hollow body, a top with an inlet for receipt of beverage, a bottom, a base for supporting the bottom above a support surface, and a dispensing faucet adjacent the bottom for dispensing beverage from the bottom, the improvement being a surface covering assembly, comprising:

a relatively rigid, substantially air impermeable, movable surface-covering member with a perimeter slightly smaller than that of an interior surface of the hollow body and which generally conforms to a cross sectional shape of the interior surface;

means for mounting the movable surface-covering member within the body and on top of a top surface of the beverage within the hollow body to reduce contact of air within the body with the surface of the beverage; and means for passing beverage from the inlet to a portion of the body beneath the surface covering members, the passing means including an elongate hollow tube extending from the inlet and through an opening in the relatively rigid, movable surface-covering member.

14. The beverage dispensing urn of claim 13 in which the hollow body has an evacuated, double wall construction.

15. The beverage dispensing urn of claim 13 in which the means for mounting the surface-covering member includes relative dimensions that enables close engagement of sides of the relatively rigid movable insulating member with the interior surface.

16. The beverage dispensing urn of claim 15 in which the mounting means includes means for enabling the surface covering means to float on top of the beverage.

17. The beverage dispensing urn of claim 13 in which the body has an open top that is substantially coextensive with the bottom and the surface-covering member and including a removable top cover for closing the open top that is substantially coextensive with the bottom.

18. The beverage dispensing urn of claim 17 in which the body, the removable top cover and the surface covering member all have a double-walled evacuated construction to provide thermal insulation to the beverage.

19. In a beverage dispensing urn having a hollow body, a top with an inlet for receipt of beverage, a bottom, a base for supporting the bottom above a support surface, and a dispensing faucet adjacent the bottom for dispensing beverage from the bottom, the improvement being a method of reducing heat transfer of the beverage, comprising the steps of:

insulating the body;

insulating a top surface of the beverage with a movably mounted insulating member that covers in contact with at least a significant portion of the entire surface by floating the movable mounted insulating member on top of the beverage within the body, passing beverage received at the inlet into a portion of the body beneath the movably mounted insulating member through an opening in the movably mounted insulating member, the step of passing including the step of passing the beverage from the inlet through an elongate tube that slideably extends through the opening in the movably mounted insulating member.

20. The method of claim 19 in which the step of insulating a top surface of the beverage with a movably mounted insulating member includes the step of floating the movably mounted insulating member on top of the beverage within the body.

21. The method of claim 19 including the step of passing beverage received at the inlet into a portion of the body beneath the movably mounted insulating member.

22. The method of claim 21 in which the step of passing includes the step of passing the beverage through an opening in the movably mounted insulating member.

23. In beverage dispensing urn having a hollow body, a top with an inlet for receipt of beverage, a bottom, a base for supporting the bottom above a support surface, and a dispensing faucet adjacent the bottom for dispensing beverage from the bottom, the improvement being a method of reducing heat transfer of the beverage, comprising the steps of:

insulating the body with a vacuum contained within a double-walled construction of the body;

insulating a top surface of the beverage with a movably mounted insulating member that covers and is in contact with at least a significant portion of the entire surface; and passing the beverage through a gap between the surface-covering member and an interior surface of the body.

24. The method of claim 23 in which the step of insulating the body includes the step of insulating the body with a vacuum contained within a double-walled construction of the body.

25. The method of claim 23 including the step of passing beverage into the hollow body with a tube with a tube that extends from the inlet and through the surface covering member to an outlet end located beneath the surface-covering member.

26. The method of claim 23 including the steps of passing the tube through an opening in the surface-covering member, and sliding the covering member along the tube while within the opening during movement of the surface-covering member.

27. In a beverage dispensing urn having a hollow body, a top with an inlet for receipt of beverage, a bottom, a base for supporting the bottom above a support surface, and a dispensing faucet adjacent the bottom for dispensing beverage from the bottom, the improvement being a surface covering assembly, comprising:

a relatively rigid, substantially air impermeable, movable surface-covering member with a perimeter slightly smaller than that of an interior surface of the hollow body and which generally conforms to a cross sectional shape of the interior surface; and means for mounting the movable surface-covering member within the body and on top of a top surface of the beverage within the hollow body to reduce contact of air within the body with the surface of the beverage;

means for passing beverage from the inlet to a portion of the body beneath the surface-covering member including an elongate hollow tube extending from the inlet and through an opening in the relatively rigid, movable surface-covering member, said passing means also including an opening in the relatively rigid movable insulating member for the passage of beverage from the inlet to a location beneath the surface-covering member.

28. In a beverage dispensing urn having a hollow body, a top with an inlet for receipt of beverage, a bottom, a base for supporting the bottom above a support surface, and dispensing faucet adjacent the bottom for dispensing beverage from the bottom, the improvement being a surface covering assembly, comprising:

a relatively rigid, substantially air impermeable, movable surface-covering member with a perimeter slightly smaller than that of an interior surface of the hollow body and which generally conforms to a cross sectional shape of the interior surface; and means for mounting the movable surface-covering member within the body and on top of a top surface of the beverage within the hollow body to reduce contact of air within the body with the surface of the beverage; and means for passing beverage from an inlet to a portion of the body beneath the surface covering means including a gap between interior sides of the body and sides of the surface-covering body, and in which the surface-covering member provides a continuous covering surface between perimeter edges of the surface covering member, and the gap provides the only passageway for beverage to be passed to the portion of the body beneath the surface-covering member.

* * * * *